United States Patent [19]

Dean

[11] 4,030,262

[45] June 21, 1977

[54] BUILDING PANEL CONNECTOR ASSEMBLY AND THE LIKE

[76] Inventor: Almeta C. Dean, 1681 La Cresta Drive, Pasadena, Calif. 91103

[22] Filed: Jan. 15, 1975

[21] Appl. No.: 541,280

Related U.S. Application Data

[63] Continuation of Ser. No. 377,220, July 9, 1973, abandoned, which is a continuation-in-part of Ser. No. 187,726, Oct. 8, 1971, abandoned.

[52] U.S. Cl. ..... 52/583; 52/295; 52/285; 52/587

[51] Int. Cl.[2] ..... E04B 1/41; E04C 5/16

[58] Field of Search ..... 52/295, 582, 583–586, 52/284, 285, 274, 275, 227, 593, 280, 244, 587

[56] References Cited

UNITED STATES PATENTS

| | | | |
|---|---|---|---|
| 1,753,451 | 4/1930 | Tonnelier | 52/227 |
| 2,737,266 | 3/1956 | Gross | 52/280 |
| 3,349,528 | 10/1967 | Salt | 52/593 |
| 3,513,610 | 5/1970 | Devonport | 52/587 |

FOREIGN PATENTS OR APPLICATIONS

| | | | |
|---|---|---|---|
| 1,101,308 | 4/1955 | France | 52/583 |
| 683,562 | 2/1965 | Italy | 52/583 |
| 617,621 | 2/1949 | United Kingdom | 52/593 |

*Primary Examiner*—Price C. Faw, Jr.
*Assistant Examiner*—James L. Ridgill, Jr.
*Attorney, Agent, or Firm*—Christie, Parker & Hale

[57] ABSTRACT

The present invention provides a building panel connector assembly operable to secure prefabricated building panels to one another while permitting rectilinear movement of the panels in response to natural conditions, for example. A footing mounting means is operable to secure the building panels to a footing for example.

3 Claims, 6 Drawing Figures

BUILDING PANEL CONNECTOR ASSEMBLY AND THE LIKE

CROSS REFERENCE TO RELATED APPLICATIONS

This is a continuation of application Ser. No. 377,220, filed July 9, 1973, abandoned on the filing of this application, which in turn was a continuation in part of application Ser. No. 187,726, filed Oct. 8, 1971, now abandoned.

FIELD OF THE INVENTION

This invention relates to building connectors and, more particularly, to connector assemblies for fastening together prefabricated building panels and the like.

DESCRIPTION OF THE PRIOR ART

Building connectors known in the art have employed means operable to fixedly mount building panels, such as floor-to-ceiling wall panels, to one another, to pillars, or to footing members. These fastening means have commonly been too rigid to allow for natural movement of the wall panels due to seasonal climatic changes or to settling of the building. Ideally, any movement permitted to a wall panel of a building should be limited to the movement in the plane of the panel so as to prevent unnecessary cracking of the wall coverings either applied directly to the panel or built up on the panel.

Many forms of known panel connectors, especially those useful with precast building panels and the like, are difficult to connect to the panel in the first instance, and also present difficulty in completing the connections to an adjacent wall panel or other element of the building.

Another requirement of a satisfactory panel connector is the accommodation of loads from adjacent portions of the building without damage to the connector itself or to the building panel or module directly affected by the connector. Further, the connector should be structurally simple for strength and ease of installation.

SUMMARY OF THE INVENTION

This invention provides a simple, effective, economic and efficient building panel connector which possesses the previously mentioned advantageous features without the disadvantages. The connector is especially useful in the context of precast concrete wall and corner panels, for example.

Generally speaking, the connector assembly includes a pair of anchor assemblies. Each anchor assembly includes an elongate metal anchor channel. Each anchor assembly also includes means for ridgidly securing each channel in an upwardly open disposition to a horizontal upper edge of a building panel, or other similar construction module, adjacent the corner thereof so that, in the building, the channel is aligned with and is substantially contiguous to the other channel of the pair. The securing means for each channel includes elongate means adapted to be embedded in the material of the respective module. The connector assembly also includes an elongate connector plate which is configured to mate intimately within the aligned anchor channels, between the flanges thereof, to constrain the anchor assemblies to relative movement only in the direction of the elongate extent of the channels. Further, the connector assembly includes a pair of threaded fasteners cooperating between each channel at spaced locations therealong through corresponding apertures in the connector plate for coupling the channels and the connector plate in their mated engagement. The fasteners, in such cooperation, are fixed from movement relative to the respective channel in a direction along the elongate extent of the channel. The connector plate apertures associated with one channel are round and are sized to mate intimately with corresponding fasteners to fix the plate to the one channel. The fastener apertures in the plate which are associated with the other channel are oversized and, in cooperation with the mated engagement of the plate with the other channel, constrain the other channel to move relative to the plate only in the direction of the elongate extent of the other channel.

The anchor channel and their securing means are arranged to be secured to the building panel at the time of construction or prefabrication of the panel. The fastener means are arranged for coupling the connector plate and anchor assemblies together during assembly of the building sometime later.

DESCRIPTION OF THE DRAWINGS

The above-mentioned and other features of this invention are more fully set forth in the following description of presently preferred embodiments of the invention, which description is presented with reference to the accompanying drawings, wherein.

DESCRIPTION OF THE ILLUSTRATED EMBODIMENTS

Figure 6:
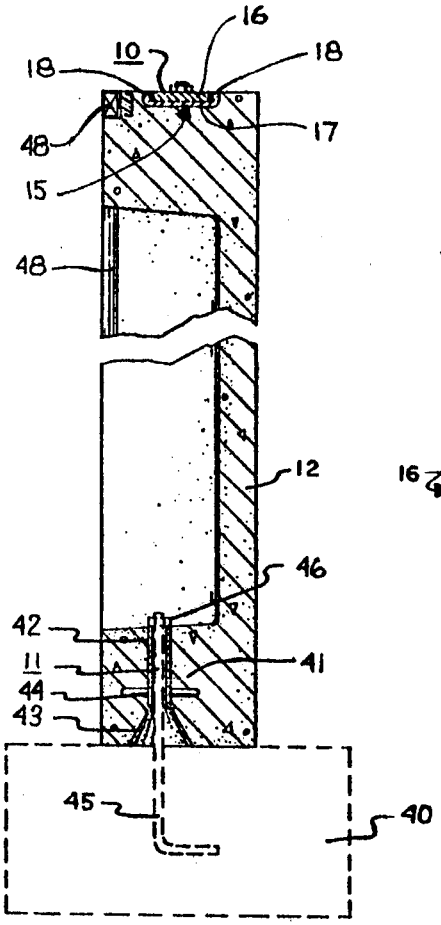
FIG. 6 is a side elevational cross-section view of a building panel provided with footing fastening means and the present connector assembly.

As shown in FIG. 6, a precast concrete wall panel 12 is comprised of a top connector assembly 10 and a footing mounting means 11. Panel 12 preferably is a precast concrete wall panel of the type as would be produced by the use of the casting bed described in my copending application Ser. No. 187,036; in view of the following description, it will be appreciated that panel 12 may also be a precast corner module. Connector assembly 10 is arranged in panel 12 so that, when the panel is connected to an adjacent wall panel or other modular construction element in a desired building, panel 12 is permitted by the connector assembly to move rectilinearly relative to the adjacent building module in the plane of the wall panel.

Figure 5:
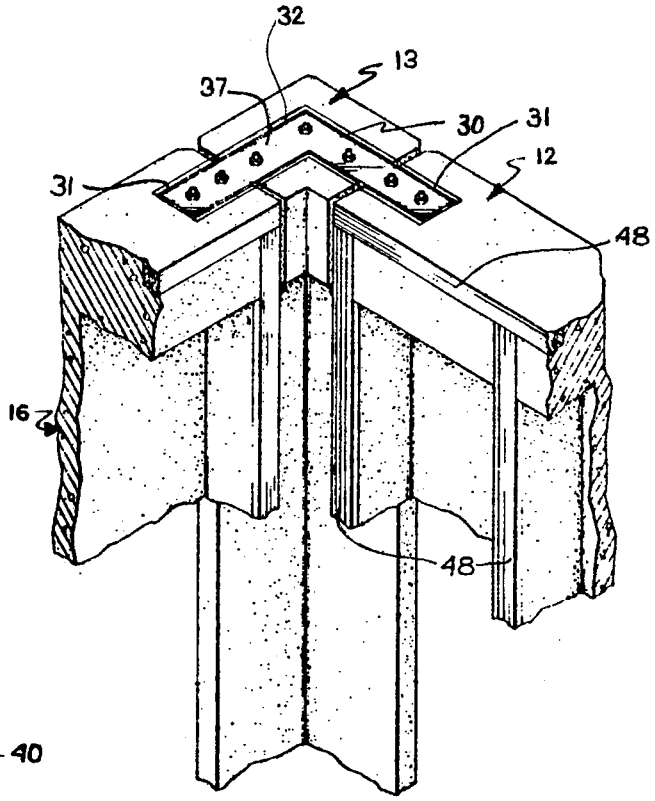
FIG. 5 is a perspective view showing the connector assembly of FIG. 3 in use with a prefabricated concrete corner panel and two prefabricated concrete wall panels.

To the extent that connector assembly 10 is described with respect to certain positions or attitudes, e.g., top or bottom, of wall panel 12 or corner panel 13, it will be understood that such terms refer to the features which the panels possess in the assembled building, as shown in FIG. 5 for example. It will be understood that, preferably, the wall panels or corner panels are fabricated flat in a horizontal position so that, upon curing of the concrete thereof, they may be moved, usually sometime later, into the upright position contemplated by the illustration of FIG. 5.

Figure 1:
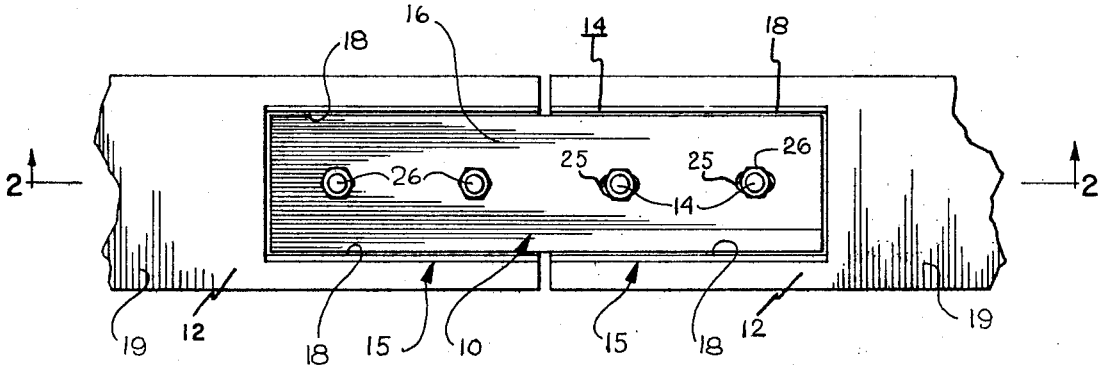
FIG. 1 is a top view of a connector assembly shown with two adjoining wall panels.
Figure 2:
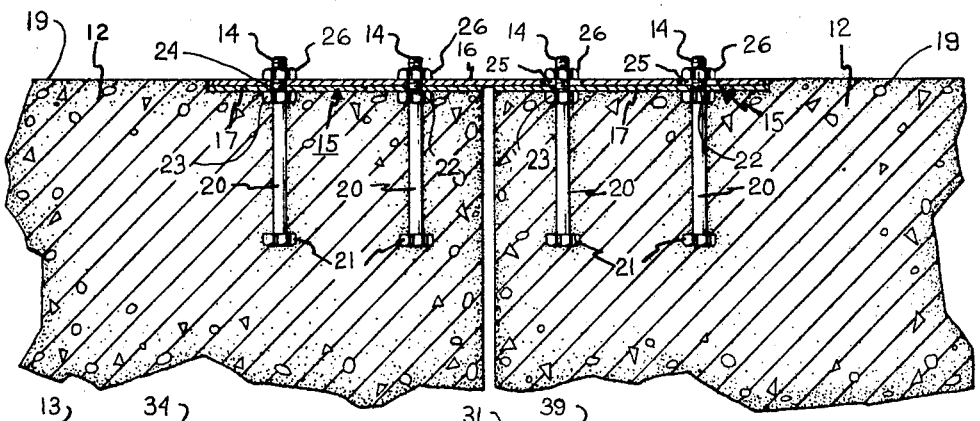
FIG. 2 is a fragmentary cross-section view taken substantially along line 2—2 of FIG. 1.

As shown in FIGS. 1, 2 and 6, connector assembly 10 includes a pair of anchor assemblies 15 and a connector plate 16. Each anchor assembly is composed in principal part of an elongate anchor channel 17 having opposed parallel flanges 18 extending in the same direction from the channel web along its opposite edges. Where the connector assembly is a connector assembly for interconnecting a pair of wall panels 12 at their upper adjacent corners, anchor channels 17 are identical. Each anchor assembly 15 also includes anchor means for rigidly securing each anchor channel in an upwardly open disposition to a horizontal upper edge of wall panel 12 adjacent a corner thereof so that the anchor channel is aligned with and substantially contiguous to the other anchor channel of the anchor assembly when the panel is placed in its appropriate juxtaposed relation to another wall panel in the building, as shown in FIG. 1 for example. As shown in FIG. 2, the anchor means of each anchor assembly are so arranged that where, as preferred, wall panel 12 is a precast concrete wall panel, the anchor channel and its anchor means may be embedded in the concrete of the wall panel at the time of casting the wall panel. Thus, the anchor channels are embedded in the top surface 19 of the wall panel and open upwardly therefrom.

Conveniently, the anchor means for each anchor assembly comprise a pair of elongate bolts 20 having heads 21 embedded within the concrete of the wall panel. The bolts have threaded ends 14 which pass through circular apertures 22 formed in the web of the anchor channel, preferably along the middle of the channel as shown best in FIG. 1. To implement appropriate positioning of the anchor channel in the wall panel, a nut 23 is threaded onto each bolt to engage the bottom surface of the anchor channel. Such engagement of nut 23 with the bottom surface of the anchor channel also serves to facilitate transfer of load from an adjacent building element to the material of the wall panel in the ultimate building. Preferably, anchor bolts 20 are disposed vertically in the wall panel perpendicular to the plane of the web of the adjacent anchored channel thereby to further facilitate the effectiveness and safe transfer of load into the material of wall panel from an adjacent building module supported by the wall panel.

As shown best in FIG. 1, connector plate 16 is an elongate metal element which has a length sufficient to extend along the elongate extent of both anchor assemblies of connector assembly 10 when the anchor assembly is put together. Connector plate 16 has a width sufficient to make snug mating engagement between the opposite flanges 18 of each anchor channel. As shown in FIG. 6, for example, connector plate 16 may have a thickness corresponding to the height of flanges 18. The connector plate has two round holes 24 formed through it adjacent one end thereof for cooperation with the projecting threaded ends 14 of the anchor bolts associated with one of the anchor channels of the connector assembly. The connector plate also has formed through it two elongate slot apertures 25 for cooperation with the projecting ends of the anchor bolts associated with the other anchor channel of the connector assembly. Preferably holes 24 and slot apertures 25 are aligned along a common line down the center of the width of the connector plate. When the connector plate is engaged over the threaded ends of the anchor bolts 20 which project through the top surfaces of anchor channels 17, and the connector plate is securely clamped and coupled to the anchor channels by nuts 26 as shown in FIG. 2, the anchor channels are interconnected by the anchor plate in such manner that they can move only linearly relative to each other along a line defined by the elongated extent along the plate.

Preferably the anchor channels are disposed in wall panels 12 to be aligned with the basic plane of the wall panel. Thus, in the assembled connector assembly 10, as shown in FIG. 1, each adjacent interconnected wall panel is permitted to move relative to the other panel in the plane of the panel. Such relative movement of the panels may occur in response to settling of the foundation of the building, or in response to expansion of the wall panel by reason of temperature changes.

Connector assembly 10 as illustrated in FIGS. 1, 2 and 6 has a connector plate 16 having a thickness equal to the height of anchor channel flanges 18 above the webs of channels 17. It is within the scope of this invention that anchor channel flanges 18 may be substantially higher than the thickness of connector plate 16 so as to provide a receiving space for nuts 26 and projecting ends 14 of anchor bolts 20, so that all elements of the connector assembly can be recessed below the top surface 19 of the respective wall panel. On the other hand, as shown in FIG. 2, for example, nuts 26 and the upper ends of bolts 20 may project beyond the wall panel top surfaces 19 so as to provide keying structures, for example, for cooperation with other modular building elements engaged on top of the wall panels or the like, interconnected by the connector assembly. As an example, in the arrangement shown in FIG. 2 the projecting ends 14 of anchor bolts 20 and associated coupling nuts 26 may provide a means for transferring the load of a roof truss element and the load thereof to interconnected wall panels 12.

Figure 3:
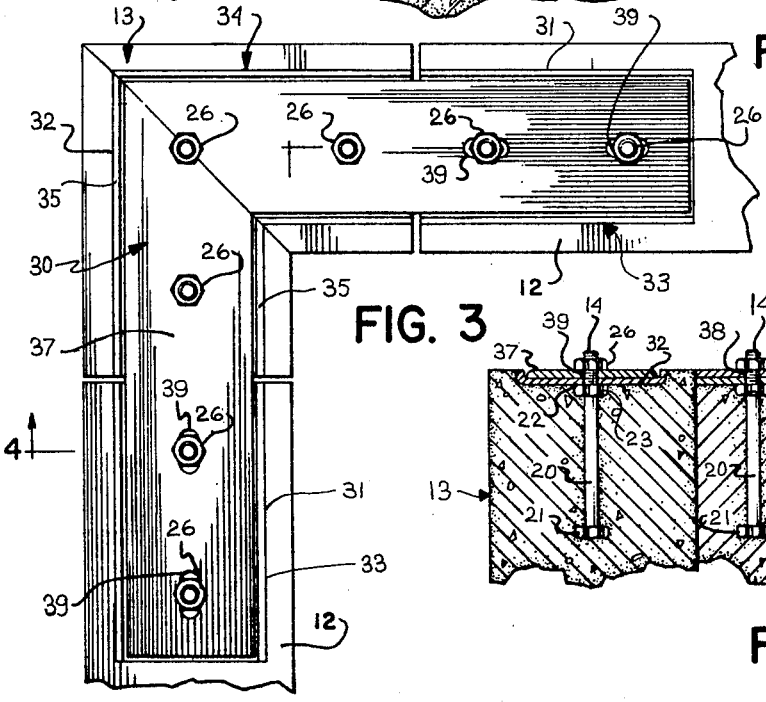
FIG. 3 is a top plan view of another connector assembly for connecting panels at a corner.
Figure 4:
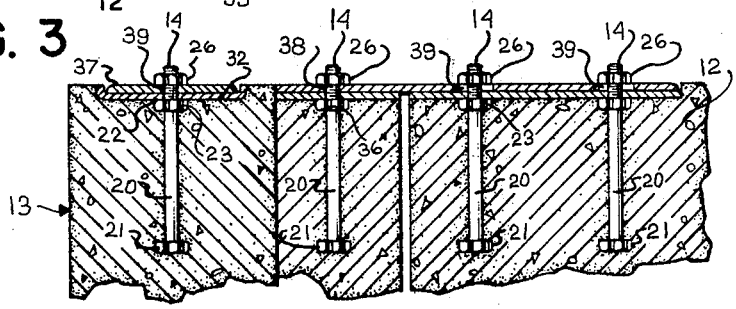
FIG. 4 is a fragmentary cross-section view taken substantially along the line 4—4 of FIG. 3.

Another connector assembly 30 is shown in FIGS. 3 and 4 for use in conjunction with a corner panel 13 and a pair of wall panels 12 (see FIG. 5). Anchor assembly 30 includes a pair of wall panel anchor channels 31 which are essentially identical to anchor channels 17 described above. Connector assembly 30 also includes a corner panel anchor channel 32 which is similar in cross section to each of anchor channels 31 but which, in plan view as seen in FIG. 3, is angled to correspond to the included angle defined by corner panel 13. Corner anchor channel 32 is so configured and so disposed in the corner panel that it has the vertex of its angle aligned with vertex of the included angle of the corner panel. Wall anchor channels 31 and corner anchor channel 32 are components of wall and corner anchor assemblies 33 and 34, respectively.

As shown best in FIG. 4, corner anchor channel 32 has upstanding flanges 35 extending along the parallel sides of the web thereof, which flanges are spaced a distance equal to the spacing of flanges 18 of the wall anchor channels and have the same height as the flanges of the wall anchor channels. The corner anchor channel 32 is secured rigidly to the material of corner pad 13 by a plurality, preferably three, of anchor bolts 20 which are disposed in the material of the corner panel in the manner described above, preferably by use of the procedures referred to above. The upper ends 14 of the corner anchor bolts are passed through corresponding circular holes 36 formed through the web of the corner anchor channel at predetermined locations thereof. Preferably, holes 36 are formed through the corner anchor channel at the vertex of the anchor channel and also adjacent the ends of the legs of the anchor channel in spaced relation to the vertex hole.

Corner connector assembly 30 also includes a connector plate 37 which is of planar definition and is bent in the plane thereof at an angle corresponding to the angle defined by corner anchor channel 32. Anchor plate 36 has an overall length, i.e. developed length, which is sufficient to assure that when the connector plate is engaged over the upper ends 14 of the all anchor bolts 20 associated with the corner connector assembly, the connector plate extends the full length of the three anchor channels of the assembly. Consistent with the foregoing description, connector plate 16 has a width sufficient to cause the connector plate to mate snugly between the flanges of the wall and corner anchor channels. The connector plate has defined therein three circular apertures 38 for cooperating snugly with the upper end of the corner anchor bolts 20 and two pairs of elongate slot apertures 39 for cooperating with the upper ends of the anchor bolts associated with wall anchor channels 41. Accordingly, when the connector plate is engaged with the upper projecting ends 14 of all the anchor bolts of connector assembly 30, and the connector plate is securely clamped down and coupled to the anchor channels by nuts 26, the connector plate is held in fixed position relative to the corner anchor channel but is slideable relative to the wall anchor channels along the elongate extents of the wall anchor channels. In this manner, wall panels 12 can move in their respective planes relative to corner panel 13 to accommodate settling of the building foundation or expansions associated with temperature changes, for example.

An exemplary means 11 for mounting wall panel 12, for example, to a footing 40 is shown in FIG. 6. Wall panel 12 has a footing flange 41 which carries the footing connection means 11. The footing connection means include an anchor sleeve 42 vertically embedded in the footing flange 41 of the wall panel to open to the upper surface thereof. The lower end of sleeve 42 is flared to define a conical recess 43 opening concave into the bottom surface of the footing flange. Sleeve 42 carries outwardly projecting bars 44 which preferably are embedded in the concrete which defines footing flange 41, such embedment occurring by prepositioning the sleeve in the form in which wall panel 12 is cast as, for example, according to the procedure described in my copending application Ser. No. 187,036. Wall panels may be connected to footing 40 by engaging sleeve 42 over the threaded upper end of a tie-down bolt 45 which has its lower end embedded in the footing. A nut 46 is then threaded onto the upper end of tie-down bolt to engage the top sleeve 42. The tension forces generated in the tie-down bolt by tightening of the nut are transmitted to the wall panel footing flange via sleeve 42 and projecting bars 44 so that the wall panel is securely held tight against footing 40. The downwardly opening conical recess 43 facilitates the positioning of the wall panel over the upwardly projecting tie-down bolt 45.

As illustrated in FIGS. 5 and 6, preferably wall panels 12 carry nailing or fastening attachments 48 at appropriate locations. Preferably the nailing or fastening attachments are disposed horizontally along the inner top surfaces of the wall panels and also vertically along inner faces of integral reinforcing flanges of the wall panels.

Connector assemblies 10 and 30 have the feature that in elevation, i.e., as viewed in FIGS. 2 and 4, they are of low profile and occupy little space, apart from anchor bolts 20, in the panels in which they are used. On the other hand, the connector assemblies in plan view, i.e., as viewed in FIGS. 1 and 3, have substantial area. In this manner the connector assemblies are operable to distribute applied loads at the corners of the panels interconnected by them over a maximum area of the panels. The anchor bolts of the connector assembly are operable to transfer such loads into a large volume of the material defining the interconnected panels. In this manner substantial loads may be transferred via the connector assemblies from panel to panel with minimum risk of damage to the material of the panels.

It will also be observed that the anchor assemblies are readily accessible once the panels carrying the anchor channels thereof are disposed in their appropriate juxtaposed relation in a building. It follows that the connector assemblies may be put together rapidly and without difficulty by engagement of the connector plates over the projecting upper ends of the anchor bolts and by engagement of clamp nuts 26. This feature of the present connector assembly is to be contrasted with the cumbersome and difficult completion procedures and access features possessed by other prior connector assemblies.

It will be understood by persons skilled in the art to which this invention pertains that, if desired, anchor bolts 20 may be carried only by the anchor channels of the connector assembly and provide no function for securing the connector plate into mated engagement with the anchor channels. For example, anchor bolts 20 might be Nelson studs secured to the underside of the anchor channels; the mechanism for clamping the connector plate to the anchor channels may be provided by threaded recesses formed in the anchor channel for receiving bolts passed through appropriate holes or slot apertures in the connector plate. It is believed however, that the arrangement described above and shown in the drawings is both structurally simple and efficient to use both in terms of pre-installation of the anchor channels in the wall panels as well as in assembly of the connector plate to the anchor channels upon erection of the building. Also, the portions of anchor bolts 20 which are disposed below the bottom surfaces of the anchor channels constitute means for anchoring the anchor channels to the wall or corner panels at a time different from the time at which the upper threaded ends of the anchor bolts serve as fastening means for securing the connector plate to the anchor channels.

Workers skilled in the art to which this invention pertains will readily appreciate that the connector assemblies described above are presently preferred embodiments of this invention which have been presented by way of example. Such workers will appreciate that changes or modifications may be made in the structures of the specific connector assemblies described above without departing from the basic teachings of this invention. Accordingly, the foregoing description should not be considered as limiting the scope of this invention.

What is claimed is:

1. A connector assembly for connecting together adjacent structural modules in a building of substantially modularized construction, the connector assembly comprising a pair of anchor assemblies each including an elongated metal anchor channel and means for rigidly securing each channel in an upwardly open disposition to a horizontal upper edge of a module adjacent a vertical edge thereof to be aligned with and substantially contiguous to the other anchor channel of the pair in a building for intimate mating receiving engagement between the flanges thereof with a connector plate of the connector assembly, the securing means for each anchor channel including elongate means connected to the channel to extend substantially normal to the channel and adapted to be embedded in the material of a module, an elongate connector plate configured to mate within the anchor channels of the anchor assemblies intimately between the flanges thereof, a pair of threaded fasteners cooperating between each anchor channel at spaced locations therealong through corresponding apertures in the connector plate for coupling the connector plate and the anchor assemblies in said mated engagement, the fasteners in said cooperation being fixed from movement relative to the respective channel in a direction along the elongate extent of the channel, the connector plate fastener apertures associated with one anchor channel of the pair thereof being round and sized to mate intimately with the corresponding fasteners for securing the connector plate fixedly to the one channel, the connector plate fastener apertures associated with the other anchor channel being oversized for connecting the connector plate to the other anchor channel and, in cooperation with said mated engagement of the connector plate with said other channel, for constraining the other channel to move relative to the connector plate only in the direction of the elongate extent of the other channel.

2. A connector assembly according to claim 1 wherein the fastener means comprise threaded members extending from the anchor channels.

3. A connector assembly according to claim 1 wherein the securing means for each anchor channel comprises a pair of elongate anchor bolts disposed substantially normal to the anchor channel and adapted to have the major portion of the length thereof and the heads thereof embedded in the module, and wherein the fastener means comprises threaded ends of the bolts projecting from the anchor channel between and in the direction of the flanges thereof.

* * * * *